United States Patent [19]

Fujimaki et al.

[11] Patent Number: 4,746,470

[45] Date of Patent: May 24, 1988

[54] PROCESS FOR THE PREPARATION OF CARBON FIBERS HAVING STRUCTURE REFLECTED IN CROSS SECTIONAL VIEW THEREOF AS RANDOM MOSAIC

[75] Inventors: Hiroto Fujimaki, Kokubunji; Ikuo Seo, Iwaki; Kiyoshi Tagaya, Iwaki; Yasuo Sakaguchi, Iwaki, all of Japan

[73] Assignee: Kureha Kagaku Kogo Kabushiki Kaisha, Japan

[21] Appl. No.: 601,122

[22] Filed: Apr. 18, 1984

Related U.S. Application Data

[63] Continuation of Ser. No. 352,533, Feb. 26, 1982, abandoned.

[30] Foreign Application Priority Data

Mar. 12, 1981 [JP] Japan ..... 56-35576

[51] Int. Cl.[4] ..... D01D 5/18; D01F 9/14

[52] U.S. Cl. ..... 264/29.2; 264/8; 264/83; 264/211.1; 264/211.17; 264/555; 423/447.1; 425/8

[58] Field of Search ..... 423/447.2, 447.1; 264/29.2, 83; 211.1, 211.17, 518, 555; 425/8, 437

[56] References Cited

U.S. PATENT DOCUMENTS

| | | | |
|---|---|---|---|
| 3,629,379 | 12/1971 | Otani | 264/29.2 |
| 3,649,234 | 3/1972 | Charpentier | 425/8 |
| 3,650,716 | 3/1972 | Brossard | 425/8 |
| 3,702,054 | 11/1972 | Araki et al. | 264/29.2 |
| 3,776,669 | 12/1973 | Ito et al. | 425/8 |
| 3,865,566 | 2/1975 | Kleist | 425/8 |
| 3,919,376 | 11/1975 | Schulz | 264/29.2 |
| 4,016,247 | 4/1977 | Otani et al. | 264/29.2 |
| 4,026,788 | 5/1977 | McHenry | 208/39 |
| 4,032,430 | 6/1977 | Lewis | 308/39 |
| 4,058,386 | 11/1977 | Faulkner et al. | 425/8 |
| 4,115,527 | 9/1978 | Otani et al. | 264/29.2 |
| 4,209,500 | 6/1980 | Chwastiak | 264/29.2 |
| 4,246,017 | 1/1981 | Phillips | 425/8 |
| 4,293,533 | 10/1981 | Arano et al. | 264/29.2 |
| 4,359,444 | 11/1982 | Shah et al. | 425/8 |

FOREIGN PATENT DOCUMENTS

| | | | |
|---|---|---|---|
| 2069261 | 9/1971 | France . | |
| 0952793 | 3/1964 | United Kingdom | 425/8 |
| 1313956 | 4/1973 | United Kingdom . | |
| 1496677 | 12/1977 | United Kingdom . | |
| 1496678 | 12/1977 | United Kingdom . | |

*Primary Examiner*—Jan H. Silbaugh
*Assistant Examiner*—Hubert C. Lorin
*Attorney, Agent, or Firm*—Kenyon & Kenyon

[57] ABSTRACT

A process for preparing carbon fibers wherein carbon fibers are prepared from the mesophase-pitch containing not more than 80% by weight of a quinoline-insoluble component and showing, under a polarization microscope, more than 70% of optically anisotropic region, comprising the steps of subjecting a mesophase-pitch showing a viscosity of 10 to 100 poise at a temperature of spinning of 330° to 450° C., to rotating-centrifugal-spinning in a rotating-centrifugal spinning machine with a peripheral velocity of rotating nozzle thereof of 300 to 1000 m/min and exposing the thus spun fibers of the mesophase pitch to a flow of a gas spouting into a spinning direction at a temperature of 280° to 400° C. and at a linear velocity of 50 to 200 m/sec, thereby preparing carbon fibers showing a random-mosaic structural pattern in cross section thereof perpendicular to fiber axis.

1 Claim, 2 Drawing Sheets

10μ

10μ

10μ

10μ

10μ

PROCESS FOR THE PREPARATION OF CARBON FIBERS HAVING STRUCTURE REFLECTED IN CROSS SECTIONAL VIEW THEREOF AS RANDOM MOSAIC

BACKGROUND OF THE INVENTION

This application is a continuation of application Ser. No. 352,533, filed 3/26/82, now abandoned.

The present invention relates to a process for preparing carbon fibers of high strength and high elasticity while using a mesophase-pitch, and more precisely, relates to a process or preparing carbon fibers having a structure reflected in cross-sectional view thereof as random-mosaic.

Recently, carbon fibers have been recognized as a useful material in the broad field of materials for space-navigation and general industry as well as for sports, and the demands for carbon fibers of high strength and high elasticity have been raised.

On the other hand, as a raw material for carbon fibers, various substances such as those based on polyacrylonitriles, rayons, lignins, pitches and the likes were thought of and also industrialized at the early stage of development of the carbon fibers, and now a days, two of them namely, one derived from polyacrylonitrile (PAN-derivative) and the other derived from pitch are mainly in use.

Of the carbon fibers derived from pitch, two kinds of carbon fibers have been developed, respectively from isotropic pitches and anisotropic pitches recently and are in market.

The carbon fibers derived from anisotropic pitch (hereinafter referred to as "mesophase-pitch") are obtained by a series of steps of thermally treating synthetic pitch derived from petroleum pitch, coal pitch, naphthalene or tetrabenzophenazine, etc., at a temperature of 350° to 600° C. to form a liquid-crystalline anisotropic region (the mesophase) in the pitch, spinning the pitch containing the mesophase into pitch fibers, infusibilizing the pitch in an oxidative atmosphere at 200° to 400° C. and carbonizing the thus infusibilized carbon fibers usually at 800° to 1500° C. In cases of necessity, the thus carbonized fibers are further thermally treated up to 3000° C. to be graphitized.

According to the results of observation under a polarization microscope and a scanning electron microscope and by X-ray diffraction technique, the carbon fibers derived from the mesophase-pitch have an excellent fiber structure in which molecules of mesophase-pitch are oriented in parallel to the fiber axis.

In addition, evidences have verified the existence of three basic types of the fiber structure in the carbon fibers derived from the mesophase-pitch, the respective characteristic features of the three basic-types of fiber structure appearing in the cross-sectional plane perpendicular to the fiber axis being as follows: (1) the cross sections of carbon fibers derived from the mesophase-pitch are arranged radially; (2) they are arranged quite randomly while showing a mosaic pattern and (3) they are arranged to form a pattern of a concentric circles (refer to Proceedings of XII-th Biennial Conference on Carbon, page 329, July, 1975 and Ceramics(Japan), Vol. 11(7), pages 612–621, 1976). The fiber structures corresponding to those showing the patterns are hereinafter referred to as follows: (1) radial-type structure; (2) random-mosaic-type structure and (3) onion skin-type structure, respectively in the order.

In this connection, it has been also verified that such three basic types of the fiber structure exist also in the mesophase-pitch fibers spun from the mesophase-pitch, and that each of the three basic types of the fiber structure once formed in the mesophase-pitch fibers do not receive any change during the consecutive thermal treatments such as infusibilization, carbonization and graphitization.

The facts are very important in the preparation of carbon fibers of excellent quality according to the present invention as will be explained later.

The carbon fibers derived from the mesophase-pitch, having the fiber structure in which molecules of the mesophase-pitch are oriented in parallel to fiber axis are excellent in the points of a high Young's modulus and a high yield in carbonization thereof, however, from the view point of strength, it is not necessarily superior to the carbon fibers derived from polyacrylonitrile.

One of the important factors which concerns the weakness of the carbon fibers derived from the mesophase-pitch is the cracks appearing on the fiber surface and it is said that such cracks are caused by the structure appearing on the cross-section of the fibers perpendicular to fiber axis as a radial arrangement of the cross-sections of the fibers (refer to Phil. Trans. Soc. Lond., A 294, pages 437–442, 1979). FIG. 1 of the drawing shows that such cracks ar apt to occur in the carbon fibers of the radial-type structure.

The cracks which are the defect on the surface of the carbon fibers and the cause of the reduced strength thereof appear already during the step of carbonization of the mesophase-pitch fibers of the radial-type structure, and as has been stated, such a structure is maintained without receiving any substantial change to other type of structure during the stage of carbonization.

On the other hand, the once formed cracks grow slowly during the carbonization due to thermal shrinkage of the fiber.

On the contrary, it has been recognized that such cracks do not appear on the mesophase-pitch fiber of the random-mosaic-type structure during the stage of carbonization. Consequently, it is very important to spin preferentially the mesophase-pitch fibers of the random-mosaic-type structure for obtaining the product, carbon fibers of excellent strength, i.e., those without cracks on their surface.

However, literatures describe that in the conventional process for spinning of the mesophase-pitch, the preferential formation of the carbon fibers of the random-mosaic-type structure has not been experienced (refer to Phil. Trans. Soc. Lond., A 294, pages 437–442, 1979; Applied Polymer Symposium, No. 29, pages 161–173, 1976 and Carbon, Vol. 17, pages 59–69, 1979).

According to "High Modulus Carbon Fibers from Pitch Precursor" by J. B. Barr et al. in Applied Polymer Symposium No. 29, page 169, (1976), "A well-defined onion skin structure occurs rarely and then only in the monofilament material."

Further, although both the carbon fibers of the radial-type structure and those of the random-mosaic-type structure appear in the spinning of multifilament, the former appears preferentially. Barr et al Reference describes further that "Fibers with random and radial structure are common in the multifilament yarn and often occur within the same bandle". It is considered from the description that the carbon fibers without the defects on their surface and with the random-mosaic-type structure have been obtained only partially.

As has been described, it is clear that in the preparation of highly strong carbon fibers from the mesophase-pitch, it is preferable that all the fibers are composed of the random-mosaic-type structure and do not contain the other structure, from the view point of the tensile strength of the product.

In this connection, as has been described, the respective three basic types of fiber structure have been formed in the spun mesophase-pitch fibers, and they are substantially retained as they are during the series of thermal treatments of infusibilization, carbonization and further graphitization. Consequently, it is very important to spin the mesophase-pitch fibers of the random-mosaic-type structure preferentially in advance of the thermal treatments of the mesophase-pitch fibers in order to preferentially prepare the carbon fibers of the random-mosaic-type structure.

The object of the present invention is to provide a process for preparation of the carbon fibers of the random-mosaic-type stucture preferentially and continuously from the mesophase-pitch. The term "preferential preparation" means the substantially sole preparation of the carbon fibers of the random-mosaic-type structure, and the term "continuous preparation" means the spinning of the precursor fibers, i.e., the mesophase-pitch fibers at a high productivity without breaking.

SUMMARY OF THE INVENTION

In an aspect of the present invention, there is provided a process for preparation of the carbon fibers showing the random-mosaic-type structure in their cross-section perpendicular to fiber axis in the production of carbon fibers from the mesophase-pitch containing not more than 80% by weight of quinoline-insoluble component and showing under a polarization microscope more than 70% of optically anisotropic region, comprising the steps of spinning a mesophase pitch of a viscosity of 10 to 100 poise at a temperature of spinning of 330° to 450° C. while using a rotating centrifugal spinning machine of a peripheral velocity of the rotating nozzle of 300 to 1000 m/min and exposing the spun mesophase-pitch fibers to a flow of a gas spouting into the spinning derection at a temperature of 280° to 400° C. and at a linear velocity of 50 to 200 m/sec.

DETAILED DESCRIPTION OF THE INVENTION

Figure 1:
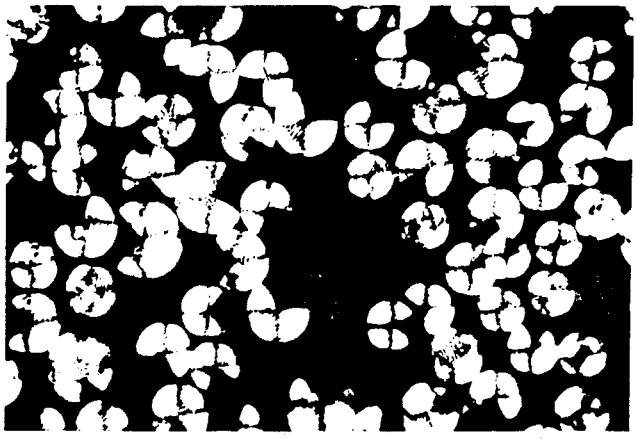
FIG. 1 is a photograph taken under a polarization microscope of the cross-sections of the carbon fibers having cracks on surface thereof, the cross sections showing the radial-type structure.

The process for spinning preferentially and continuously mesophase-pitch fibers of random-mosaic-type structure which are the precursor of the carbon fibers of random-mosaic-type structure according to the present invention is to subject a mesophase-pitch of a predetermined viscosity to rotating centrifugal spinning while exposing the thus spun mesophase-pitch fiber to a flow of a gas heated to a predetermined temperature spouting to the direction of spun fibers. The mesophase-pitch fibers obtained by such a process always show random-mosaic-type structure in their cross-section perpendicular to fiber axis, and since the fiber structure thereof substantially does not receive any change during the successive heat-treatments respectively, in infusibilization, carbonization and graphitization, solely the carbon fibers of random-mosaic-type structure, which are the object of the present invention are available. In the present invention, carbon fibers include graphitized fibers unless otherwise stated.

The spinning method according to the present invention comprises making the molten mesophase-pitch send out from the rotating nozzle in radial direction while utilizing the centrifugal force caused by the rotation of the rotating centrifugal spinning machine. As a rotating centrifugal spinning machine, a machine disclosed in U.S. Pat. No. 3,776,669 is mentioned.

However, a simple rotating centrifugal spinning procedure while utilizing a rotating centrifugal spinning machine cannot prepare the mesophase-pitch fibers which are the precursor of the carbon fibers which are the object of the present invention preferentially and continuously.

Namely, the present inventors have found that it is an indispensable condition for attaining the object that a gas heated and kept at a temperature of 280° to 400° C. is flowed into the direction of spinning of the mesophase-pitch fibers during the spinning to make the spun fibers exposed to the gas flow. In the case where the temperature of the gas is lower than 280° C., a stable and continuous spinning cannot be expected owing to the frequent occurrence of fiber-cutting during the spinning, and on the other hand, in the case where the temperature of the gas is higher than 400° C., the re-melting of the spun fibers occurs. The kind of the gas to be flowed in the direction of spinning is not particularly specified, however, gaseous nitrogen or air can be easily handled.

As has been described, the mesophase-pitch takes, in the case where it is formed into mesophase-pitch fibers, various structures such as onion-skin-type structure, radial-type structure and random-mosaic-type structure, and it has been hitherto extremely difficult to prepare the pitch-fibers consisting 100% of random-mosaic-type structure at a high productivity according to the conventional method, and concerning the concrete method for preparing the mesophase-pitch fibers consisting 100% of the random-mosaic-type structure, nothing has been disclosed. Consequently, the present invention by which the mesophase-pitch fibers consisting 100% of the random-mosaic structure have been prepared by melt-spinning of the mesophase-pitch and by exposing the spun mesophase-pitch fibers to a flow of a gas heated to a predetermined high temperature and flowed to the direction of spinning is extremely remarkable.

The precursor in the present invention, i.e., the mesophase-pitch is exemplified by the pitch showing optical aniosotropy disclosed in Japanese Patent Publication No. 49-8634 (1974) and a pitch containing 40 to 90% by weight of a quinoline-insoluble component disclosed in Japanese Patent Application Laying-Open No. 49-19127 (1974), etc., however, the mesophase-pitch suitably utilizable in the present invention is the pitch in which more than 70% of optically anisotropic region is observed under a polarization microscope and which contains not more than 80% by weight of the quinoline-insoluble component. More preferably, it is the mesophase-pitch having more than 85% of optically anisotropic region and 30 to 65% by weight of the quinoline-insoluble component. In addition, such a mesophase-pitch must have properties suitable for subjecting to the rotating centrifugal spinning, the properties being (1) it can be spun at a temperature of 330° to 450° C. and (2) its viscosity at the spinning temperature of 330° to 450° C. is 10 to 100 poise, preferably, 20 to 50 poise.

The mesophase-pitch fibers having the random-mosaic-type structure and attaining the object of the present invention are obtained while using the mesophase-pitch of the properties as far as the mesophase-pitch is subjected to the rotating centrifugal spinning of the present invention, and it has been found in the present inventors' studies that the diameter of the mesophase-pitch fibers obtained by the rotating centrifugal spinning from the mesophase-pitch of a viscosity of 10 to 100 poise at the spinning temperature of 330° to 450° C. depends on the peripheral velocity of the rotating nozzle which gives the centrifugal force for spinning and the flow rate of the gas which is spouted into the spinning direction. Generally, carbon fibers of 5 to 30 microns are broadly used. Accordingly, it is preferable also in the present invention to obtain positively the carbon fibers of a diameter in the range. As a result of investigating the relationship between the fiber diameter and the peripheral velocity of the rotating nozzle or the flow rate of the gas in the case of the viscosity of the mesophase-pitch of 10 to 100 poise at 330° to 450° C., it has been found that the pitch-fibers of the preferable diameter, 5 to 30 microns, are possibly prepared in the case where both the peripheral velocity of the rotating nozzle of 300 to 1000 m/min and the spouting flow rate of the heated gas of 50 to 200 m/sec, preferably 80 to 160 m/sec are fulfilled. The spouting flow rate of the gas is the initial velocity of the gas spouting in the direction of spinning, to which the spun fibers are exposed.

According to the present invention, by exposing the spun mesophase-pitch fiber from the rotating centrifugal spinning nozzle to the spouting gas flow at a high temperature, the mesophase-pitch fibers of the random-mosaic-type structure are preferentially and continuously prepared, and by subjecting the thus prepared pitch fibers to infusibilization, carbonization and further to graphitization, carbon fibers with a favorable cross-sectional structure are preferentially obtained. Naturally, it is possible to obtain the carbon fibers with the desired diameter.

Thermal treatments for infusibilization, carbonization or graphitization, respectively in the present invention are carried out in the similar procedure to the conventional thermal treatment.

The present invention will be more precisely explained while referring to Examples as follows.

However, the present invention is not restricted to Examples under mentioned. From the foregoing description, one skilled in the art can easily ascertain the essential characteristics of this invention, and without departing from the spirit and scope thereof, can make various changes and modifications of the invention to adapt it to various usages and conditions.

EXAMPLES 1 to 4 and COMPARATIVE EXAMPLES 1 to 3

Three kinds of mesophase-pitch A, B and C shown in Table 1 were used as the raw material of carbon fibers, respectively. Two of them were derived from naphthalene synthetically and one of them was derived from a heavy petroleum oil.

TABLE 1

| | Derived from | Properties |
|---|---|---|
| A | heavy petroleum oil | ANISO(1): about 90<br>Q-ins(2): 59.0<br>Vis.(3): 38 |
| B | naphthalene | ANISO: about 90<br>Q-ins: 31.4<br>Vis.: 13 |
| C | naphthalene | ANISO: about 93<br>Q-ins: 45.5<br>Vis.: 33 |

Notes:
(1)ANISO means the percentage area occupied by anisotropical image of the specimen under a polarization microscope with crossed Nicol-prisms.
(2)Percentage by weight of the quinoline-insoluble component. (ASTM D-2318)
(3)Viscosity at 400° C. poise.

Any of the mesophase-pitch A, B and C shown in Table 1 was suitable for rotating centrifugal spinning by the spinning machine of a rotating bowl of 115 mm in diameter, a number of nozzle holes of 128 and a diameter of the nozzle hole of 0.7 mm.

Spinning of Mesophase-pitch A

Mesophase-pitch A was subjected to rotating centrifugal spinning under the two mutually different Example 1 and Example 2 according to the method of the present invention and further under the mutually different comparative Example 1 and Example 2 shown in Table 2.

TABLE 2

| | Present invention Examples | | Comparative Examples | |
|---|---|---|---|---|
| | 1 | 2 | 1 | 2 |
| Temperature of pitch (°C.) | 405 | 400 | 405 | 355 |
| Viscosity of pitch (poise) | 31 | 38 | 31 | 200 |
| Peripheral velocity(m/min) of rotating nozzle | 720 | 360 | 720 | 720 |
| Spouting velocity(m/sec) of the gas | 145 | 110 | 145 | 145 |
| Temperature of the gas (°C.) | 350 | 330 | 100 | 300 |

In the cases of spinning under the Example 1 or Example 2 according to the method of the present invention, the mesophase-pitch fibers of 12 microns (Example 1) and 15 microns (Example 2) in diameter were continuously obtained without cutting in a favorable productivity, and on the other hand, in the case of spinning under the comparative Example 1, generally the diameter of the fibers was larger as 20 to 50 microns with a considerable irregularity of diameter in each one fiber and frequent cutting during spinning resulting in the average length of the fibers of less than 50 mm. Further in the case of spinning under the comparative Example 2, the pitch sent out from the nozzle hole could not form any fiber because of the low temperature of the pitch and of the high viscosity of the pitch at the temperature, in other words, spinning was impossible.

After embedding the mesophase-pitch fibers obtained under the respective Example 1 and Example 2 according to the present invention into an epoxy-resin and grinding, both the cross section of the fibers perpendicular to fiber axis, and the section of the fibers parallel to fiber axis were observed under a polarization microscope. It was observed that in the cross section perpendicular to fiber axis, the cross sections of fiber molecules were arranged while forming random-mosaic pattern, and in the section parallel to fiber axis, band-like mesophase-pitch fiber molecules were arranged selectively to fiber axis.

In the next place, the thus obtained mesophase-pitch fibers according to the present invention were subjected to oxidative treatment of infusibilization by exposing to an air containing 1% by volume of nitrogen dioxide at 250° C. for 2 hours. It was confirmed by a polarization microscopic observation that the cross section perpendicular to fiber axis of the infusibilized fibers was substantially the same as that of the mesophase-pitch fibers.

Figure 2:
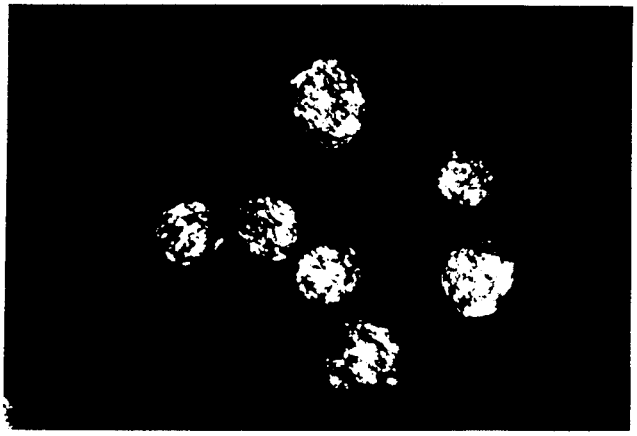
FIGS. 2 to 4 are the photographs taken under a polarization microscope of the cross-sections of the random-mosaic carbon fibers respectively obtained from mesophase-pitch in Examples 1, 3 and 4 of the present invention.

The thus infusibilized fibers were thermally treated in a gaseous nitrogen at 900° C. to obtain the carbon fibers. The cross section perpendicular to fiber axis of the thus obtained carbon fibers prepared in accordance with Example 1 showed the substantially random-mosaic-type structure as illustrated in FIG. 2 which is the photomicrograph under polarized light.

Spinning of Mesophase-pitch B

Mesophase-pitch B was subjected to rotating centrifugal spinning under the Example 3 according to the present invention and under the comparative Example 3, respectively shown in Table 3.

TABLE 3

| Conditions | Present invention Example 3 | Comparative Example 3 |
|---|---|---|
| Temperature of pitch (°C.) | 370 | 375 |
| Viscosity of pitch (poise) | 34 | 30 |
| Peripheral velocity (m/min) of rotating nozzle | 540 | 540 |
| Spouting velocity (m/sec) of the gas | 130 | 30 |
| Temperature of the gas (°C.) | 320 | 320 |

In the case of Example 3 according to the present invention, the mesophase-pitch fibers of 13 microns in average diameter were continuously prepared at a favorable productivity, and on the other hand, in the comparative Example 3, although the fibers were continuously obtained, the diameter of the mesophase-pitch fibers was as large as more than 30 microns. Both the mesophase-pitch fibers prepared according to Example 3 of the present invention and the mesophase-pitch fibers prepared under the comparative Example 3 are of the random-mosaic-type structure.

Figure 3:
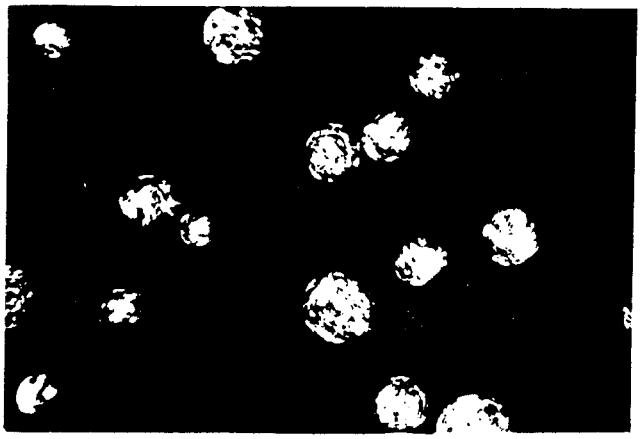

In the next place, the mesophase-pitch fibers prepared under Example 3 according to the present invention were subjected to oxidative thermal treatment in an air containing 1% by volume of nitrogen dioxide at 275° C. for one hour to be infusibilized, and the thus infusibilized fibers were successively heat-treated in gaseous nitrogen at 900° C. to obtain the carbon fibers. The thus obtained carbon fibers showed substantially cross-sections perpendicular to fiber axis of the random-mosaic-type structure as illustrated in FIG. 3. The graphitized fibers obtained by thermally treating the carbon fibers in gaseous argon at 2500° C. showed substantially the cross section perpendicular to fiber axis of the random-mosaic-type structure.

Spinning of Mesophase-pitch C

Mesophase-pitch C was subjected to rotating centrifugal spinning under the conditions shown in Table 4.

TABLE 4

| | Present Invention Example 4 |
|---|---|
| Temperature of pitch (°C.) | 395 |
| Viscosity of pitch (poise) | 40 |
| Peripheral velocity (m/min) of rotating nozzle | 720 |
| Spouting velocity (m/sec) of the gas | 150 |
| Temperature of the gas (°C.) | 340 |

Figure 4:
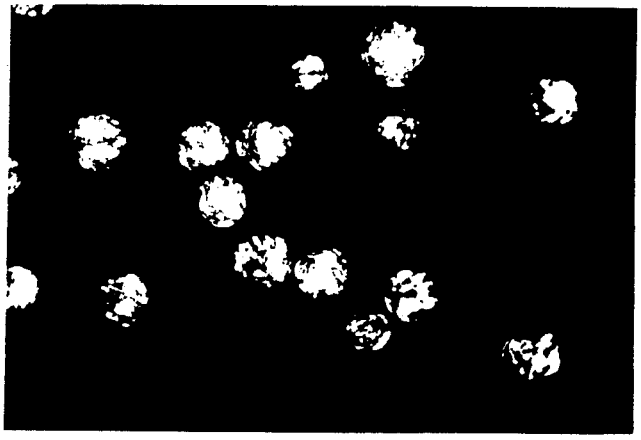

The mesophase-pitch fibers of average diameter of 12 microns were obtained continuously at a favorable productivity showing their cross section perpendicular to fiber axis of the random-mosaic-type structure. The thus obtained mesophase-pitch fibers were thermally treated for infusibilization in an air containing 1% by volume of nitrogen dioxide at 250° C. for 90 min and the thus obtained fibers were successively treated in gaseous nitrogen at 1000° C. to obtain the carbon fibers showing their cross section perpendicular to fiber axis of the random-mosaic-type structure as illustrated in FIG. 4 which is the photomicrograph under a polarized light.

What is claimed is:

1. In a process for preparing carbon fibers showing, under a polarization microscope, a random-mosaic structural pattern in the cross-section thereof perpendicular to the fiber axis, and a diameter of 5 to 30 microns, comprising melt-spinning a mesophase-pitch showing, under a polarization microscope, more than 85% of an optically anisotropic region, containing 30 to 65% by weight of a quinoline-insoluble component and subjecting the thus prepared pitch fibers to infusibilization, carbonization and further to graphitization, the improvement comprising:

melt-spinning a mesophase-pitch having a viscosity of 20 to 50 poise at a melt-spinning temperature of 330 to 450 degrees Celsius, while subjecting said mesophase pitch to rotary centrifugal spinning in a rotary centrifugal spinning machine at a peripheral velocity of the rotating nozzle of 300 to 1000 m/min., while exposing said spun mesophase-pitch fibers to a flow of a gas spouting into the spinning direction at a temperature of 280 to 400 degrees Celsius and at a linear velocity of 80 to 160 m/sec.

* * * * *

UNITED STATES PATENT AND TRADEMARK OFFICE

CERTIFICATE OF CORRECTION

PATENT NO. : 4,746,470

DATED : May 24, 1988

INVENTOR(S) : Fujimaki, et al.

It is certified that error appears in the above-identified patent and that said Letters Patent is hereby corrected as shown below:

On the cover page of the patent please correct the name of the assignee from

"Kureha Kagaku Kogo Kabushiki Kaisha" to --Kureha Kagaku Kogyo Kabushiki Kaisha--.

Signed and Sealed this

Thirtieth Day of May, 1989

*Attest:*

*Attesting Officer*

DONALD J. QUIGG

*Commissioner of Patents and Trademarks*